US005312098A

United States Patent [19]

Inoue

[11] Patent Number: 5,312,098

[45] Date of Patent: May 17, 1994

[54] PAPER FEEDING DEVICE OF FRICTIONALLY SEPARATING ROLLER MECHANISM

[75] Inventor: Tatsuya Inoue, Nara, Japan

[73] Assignee: Sharp Kabushiki Kaisha, Osaka, Japan

[21] Appl. No.: 25,098

[22] Filed: Mar. 2, 1993

[30] Foreign Application Priority Data

Mar. 3, 1992 [JP] Japan ..... 4-80253

[51] Int. Cl.[5] ..... B65H 3/52

[52] U.S. Cl. ..... 271/122

[58] Field of Search ..... 271/12, 122, 10

[56] References Cited

U.S. PATENT DOCUMENTS 5,005,025 4/1991 Miyakawa et al. ..... 346/25

FOREIGN PATENT DOCUMENTS 59-187647 12/1984 Japan .

0048341 2/1990 Japan ..... 271/122

OTHER PUBLICATIONS

Gibson, IBM Technical Disclosure Bulletin, Mar. 1976 vol. 18 No. 10 p. 3151.

*Primary Examiner*—H. Grant Skaggs

*Attorney, Agent, or Firm*—David G. Conlin; George W. Neuner

[57] ABSTRACT

The object of the present invention is to provide a paper feeding device of frictionally separating roller mechanism, which assuredly handle and separate sheets without using a torque limiter even if environmental factors such as temperature, humidity and etc. are changed. In order to achieve the object, the paper feeding device of the present invention comprises a paper feed roller 3 and reverse roller 6, both of which are made with polynorbornene rubber, and the rubber of the paper feed roller 3 is thicker by 0.5 mm than that of the reverse roller 6.

1 Claim, 7 Drawing Sheets

WHEN A SINGLE SHEET IS FED

WHEN TWO SHEETS ARE TO BE HANDLED

WHEN A SINGLE SHEET IS FED

WHEN TWO SHEETS ARE TO BE HANDLED

PAPER FEEDING DEVICE OF FRICTIONALLY SEPARATING ROLLER MECHANISM

BACKGROUND OF THE INVENTION (1) Field of the Invention

The present invention relates to a paper feeding device for copiers, and more particularly relates to an increased paper feeding device of frictionally separating roller mechanism.

(2) Description of the Related Art

As typical paper feeding devices of frictionally separating roller mechanism, there has been known one which is constructed as shown in FIG. 1. Specifically, a conventional paper feeding device of frictionally separating roller mechanism comprises: a pick-up roller 2 which presses the top surface of a paper sheet stack 1 and delivers an upper most sheet with frictional force to a nip defined between a feed roller 3 (to be referred to later) and a reverse roller 6 (to be referred to later); a paper feed roller 3 for feeding with frictional force the sheet delivered by the pick-up roller 2 in a direction of its rotation; and a reverse roller which is driven by means of a torque limiter 4 in a direction opposite to that of the paper feed roller 3 and is pressed against the paper feed roller 3 with a braking force acted by a pressure spring 5 and a braking pressure caused by a torque of the torque limiter 4. A lot of examples of such a paper feeding device using a torque limiter are known, and an example is shown in Japanese Utility Model Application Laid-Open Sho 59 No. 187647.

The rollers mentioned above generally use rubber molds made of essentially polynorbornene rubber and/or rubber molds made of essentially urethane rubber. When the paper feed roller 3 and reverse roller 6 are formed of the same material, a torque limiter 4 must be provided to the reverse roller 6. The reverse roller 6 is driven by means of the torque limiter 4 in a rotational direction opposite to the proceeding direction of sheets while the roller 6 is pressed against the paper feed roller 3 with an initial pressure acted by the pressure spring 5 and acting pressure caused by the torque of the torque limiter 4. In this arrangement, when the reverser roller 6 is in direct contact with the paper feed roller 3 or a sheet of paper is fed into the intake nip, the reverse roller 6 receives a torque beyond the limit torque and runs idle so as to be driven by the paper feed roller 3. In contrast, if two or more sheets unseparated are fed into the nip, the limit torque surpasses the frictional force between the sheets and causes the reverse roller 6 to rotate in the paper reversing direction so as to push back the lower sheet, preventing the plural sheet feeding.

On the other hand, there have been known paper feeding devices of frictionally separating roller mechanism, in which, taking advantage that urethane rubber has a smaller friction coefficient than polynorbornene, the paper feed roller 3 is formed with polynorbornene rubber and the reverse roller 6 is formed with a urethane rubber in stead of forming the paper feed roller 3 and reverse roller 6 with a like material. A paper feeding device of this type prevents the plural sheet feeding not employing a torque limiter 4 but using the difference of friction coefficient to sheets between the paper feed roller 3 and the reverse roller 6.

Nevertheless, in the paper feeding devices of frictionally separating mechanism as described above, particularly, for example, in the paper feeding device with the paper feed roller 3 and reverse roller 6 made with the same material, a sheet of paper delivered will be conveyed by a differential force between a frictional force $F_1$ caused by the paper feed roller 3 and another frictional force $F_2$ caused by the reverse roller 6 as shown in FIG. 2(*a*) (refer to FIG. 3(*a*)). When two sheets piled are delivered, the lower side sheet is separated from the upper one by a differential force between a frictional force $F_2$ caused by the torque limiter 6 and another frictional force $F_3$ generated between the sheets as shown in FIG. 2(*b*) (refer to FIG. 3(*b*)). Therefore, an appropriate pressing force is to be determined dependent upon the specification of the torque limiter ($f_1$ and $f_2$ in FIG. 3), but the range is considerably limited.

On the other hand, when used is a paper feeding device with materials of the paper feed roller and the reverse roller being different (for instance, a paper feed roller of polynorbornene rubber, and a reverse roller of urethane rubber), an appropriate pressing force is hard to select because either material has a different dependence of its friction coefficient upon the quality of paper to be used, and degradation of rubbers due to environmental conditions such as temperature, humidity, etc.

For example, in a case of using an OHP sheet (a sheet for overhead projector), the relation between the friction coefficients of urethane rubber and polynorbornene rubber is reversed (the friction coefficient of urethane rubber is larger). As a result, the situation becomes more complicated.

SUMMARY OF THE INVENTION

It is therefore an object of the present invention to provide a paper feeding device of frictionally separating roller mechanism in which the above drawbacks in the prior art paper feeding device of frictionally separating roller mechanism are eliminated, and which is capable of preventing the plural sheet feeding without using an expensive torque limiter, and can provide a proper fictional force or a pertinent feeding force for the sheet even if the environmental factors such as temperature and/or humidity, etc. are changed.

The above object can be achieved by providing a paper feeding device comprising:

a pick-up roller being pressed onto a surface of a sheet stack for delivering with frictional force a sheet into a nip defined between a paper feed roller and a reverse roller;

a paper feed roller sending out with frictional force the sheet delivered by the pick-up roller in its rotational direction; and a reverse roller being driven by the feed roller when it is in direct contact with the paper feed roller or a sheet of paper is fed into the nip, and pushing back the lower sheet by its frictional force with the sheet when two or more sheets piled are fed into the nip, being characterized in that the paper feed roller and reverse roller are made with polynorbornene rubber, and the difference of the rubber thickness $t_1$ of the paper feed roller and the rubber thickness $t_2$ of the reverse roller, that is, the value $(t_1-t_2)$ is 0.5 mm or more.

In paper feeding by frictionally separating roller mechanism, a frictional force of a paper feed roller, or a paper feeding force $F_1$ is given by a product of a pressing force f between a sheet and the roller and a friction coefficient $\mu_1$:

$$F_1=\mu_1 f.$$

On the other hand, a frictional force of a reverse roller to the sheet or a paper feeding force $F_2$ is given by a product of a pressing force f therebetween and a friction coefficient $\mu_2$:

$$F_2=\mu_2 f.$$

When the rubber thickness $t_1$ of the feed roller is 2 mm or more, and the rubber thickness $t_2$ of the reverse roller is 1.5 mm or less, the friction coefficients $\mu_1$ and $\mu_2$ are about 1.2 and 1.0, respectively. Accordingly, the following relation holds;

$$F_1>F_2.$$

As a result, the feeding force of the sheet arises (when a single sheet exists between the nip).

When two or more sheets are fed into the nip, assuming the friction coefficient between the sheets as $\mu_3$, the feeding force is given by $$F_1-F_3=\mu_1 f-\mu_3 f,$$

whereas the separating force for convening the lower sheet in the reverse direction is given by $$F_2-F_3=\mu_2 f-\mu_3 f \text{ (refer to FIG. 6(b))}.$$

In order to obtain a stable feeding force and separating force, a rubber material which suffices the following conditions is preferably used.

$$\mu_1>\mu_2,$$

$$\mu_1>\mu_3,$$

$$\text{and } \mu_2>\mu_3.$$

In the paper feeding portions of copiers, particularly in a manual paper feeding portions, a great variety of sheets are to be handled, fed and separated. In accordance with the study of the present inventors, the maximum value of the friction coefficient $\mu_3$ was found to be around 0.6. With this, a rubber material which could satisfy the above conditions was found to be polynorbornene rubber.

In addition, in order to meet and maintain the condition $\mu_1>\mu_2$, the following measures may be taken. That is, A. the paper feed roller and reverse roller are formed with the same rubber (i.e, the condition $\mu_1>\mu_2$ holds at any time, even if the coefficients vary depending upon the type of sheets, environmental conditions and degradation of quality, and B. the rubber of the reverse roller is made thinner than that of the paper feed roller to afford a difference of the friction coefficients.

BRIEF DESCRIPTION OF THE DRAWINGS

FIG. 5(*b*) is an essentially illustrative views showing a state in which a single sheet is separated when two or more sheets are delivered;

DESCRIPTION OF THE PREFERRED EMBODIMENTS

Figure 1:
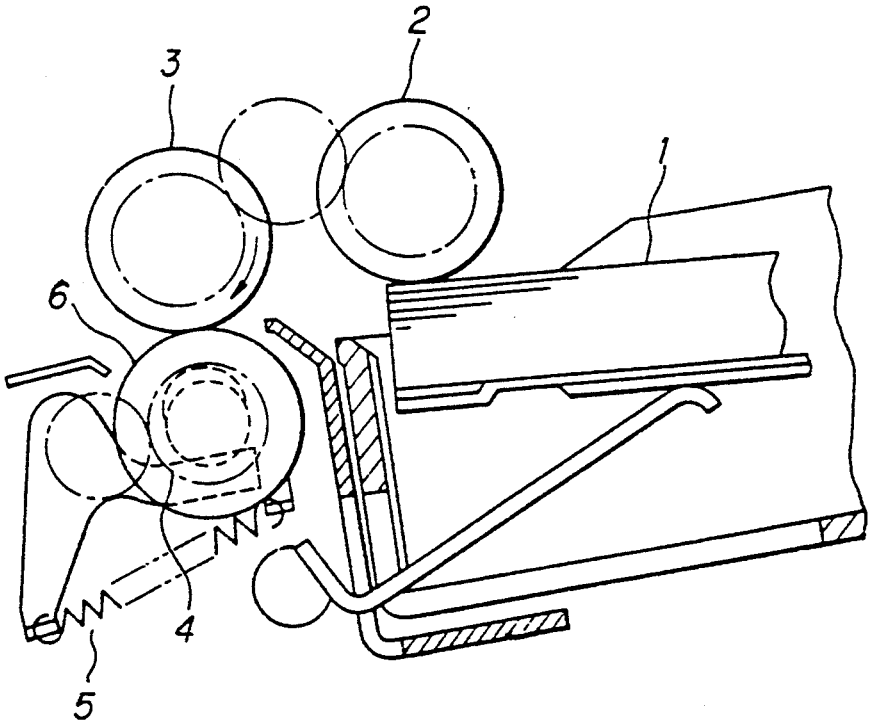
Fig. 1 PRIOR ART
FIG. 1 is an essential sectional view showing a schematic structure of a prior art paper feeding device of frictionally separating roller mechanism.
Figure 2A:
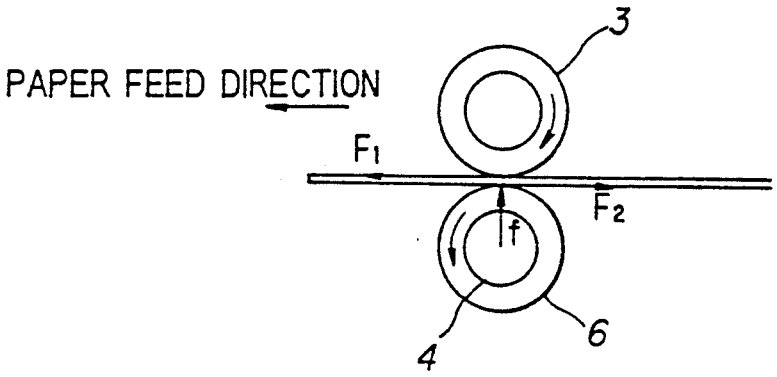
Fig. 2a PRIOR ART
FIGS. 2 (*a*) and (*b*) are illustrative views showing respective delivery states of paper in a prior art paper feeding device of frictionally separating roller mechanism.
Figure 2B:
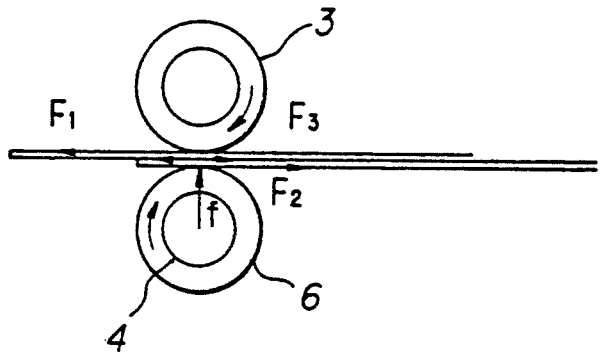
Fig. 2b PRIOR ART
Figure 3A:
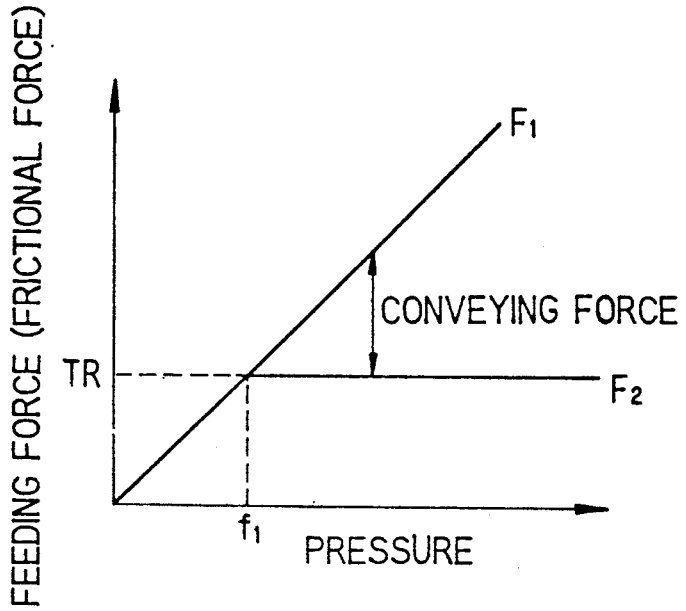
FIGS. 3 (*a*) and (*b*) are characteristic charts for illustrating the principle of paper delivery and show relations between paper feeding force and pressing force acted between rollers and paper.
Figure 3B:
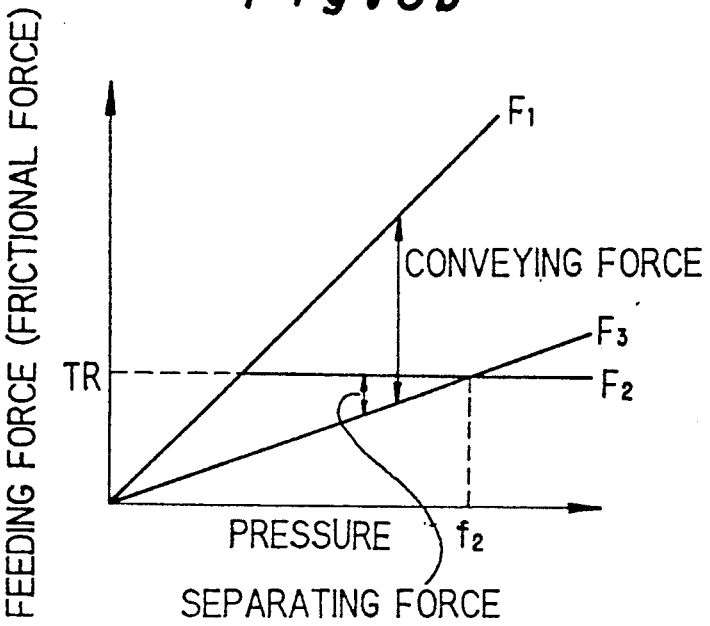

An embodiment of the present invention will hereinafter be described with reference to the accompanying drawings. Here, description will be made with allotting identical reference numerals to constituents which have the same functions with those of the prior art shown in FIGS. 1 to 3.

Figure 4:
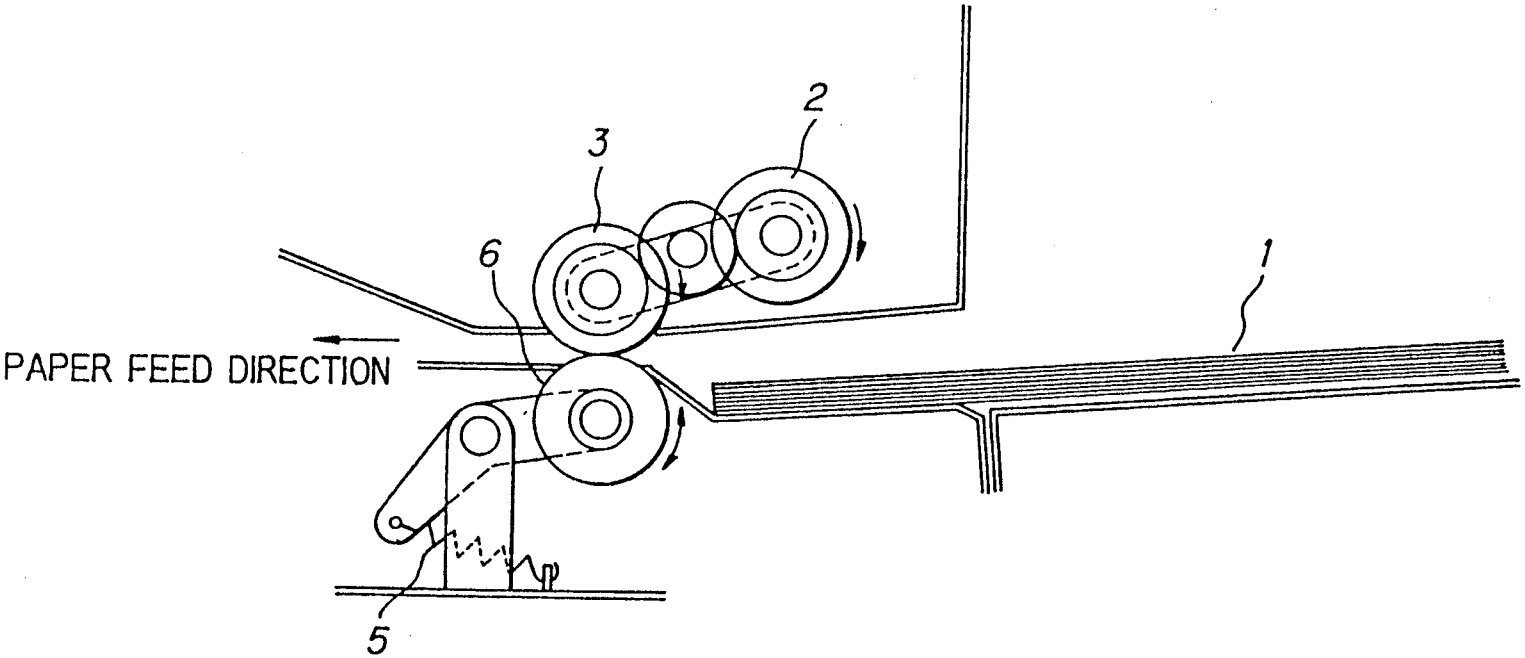
FIG. 4 is an essential sectional view showing a schematic structure of an embodiment according to the present invention.
Figure 5A:
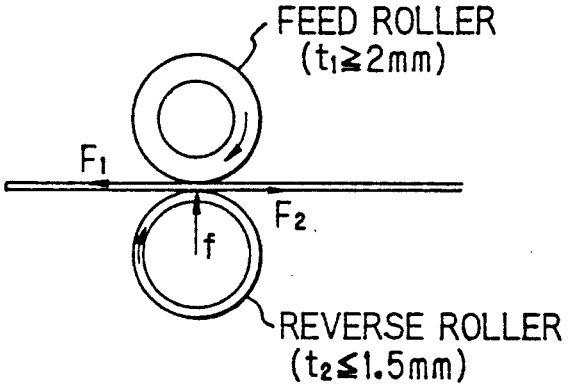
FIG. 5(*a*) is an essentially illustrative views showing a state in which a separated sheet of paper is handled in the paper feeding device of frictionally separating roller mechanism shown in FIG. 4.
Figure 5B:
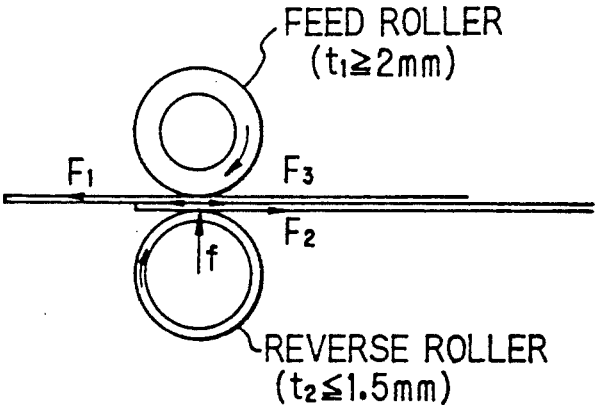

FIG. 4 is an essential sectional view showing a schematic structure of paper feeding device of frictionally separating roller mechanism of an embodiment according to the present invention.

The paper feeding device shown in FIG. 4 comprises a paper feed roller 3 made with a polynorbornene rubber layer having a thickness $t_1 \geqq 2$ mm; a reverse roller 6 made with the polynorbornene rubber layer having a thickness $t_2 \leqq 1.5$ mm; and a pick-up roller 2 made with the polynorbornene rubber layer and pressing the upper surface of sheet stack 1, and the reverse roller 6 is pressed by a pressure spring 5 with a predetermined pressure against the paper feeding roller 3.

Now description will be made on the paper feeding process of the above device. At first, the paper stack 1 is raised until the uppermost position of the stack 1 reaches a set-up position, and then a paper feeding signal is generated to trigger the rotation of the paper feeding roller 3 and the pick-up roller 2. The pick-up roller 2 which has been pressed against the top face of the paper stack with a predetermined pressure, deliver a sheet to a nip defined between the paper feed roller 3 and the reverse roller 6. After completion of the delivery, the pick-up roller 2 is released from the paper surface.

The reverse roller 6 is driven in an opposite direction to the paper proceeding direction while being pressed against the paper feed roller 3 under the combination of initial pressure of the pressure spring 5 and acting pressure of the spring caused by driving of the roller.

Figure 6A:
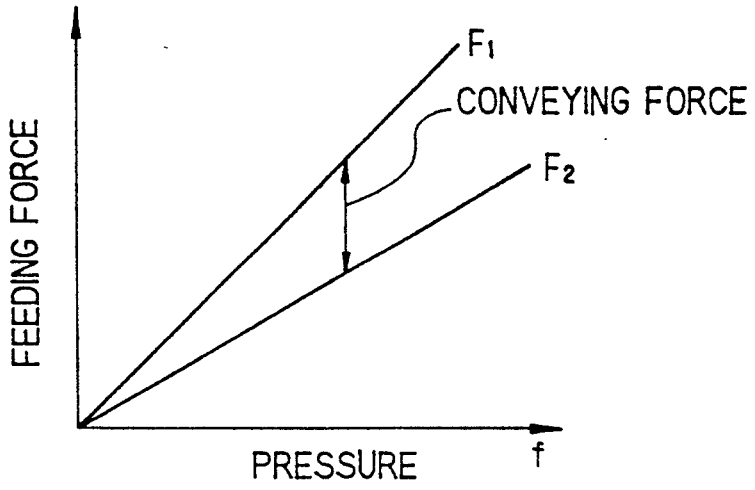
FIGS. 6 (*a*) and (*b*) are characteristic charts for illustrating the principles of paper separation corresponding to FIGS. 5(*a*) and 5(*b*) and show relations between paper feeding force and pressing force acted between rollers and paper.
Figure 6B:
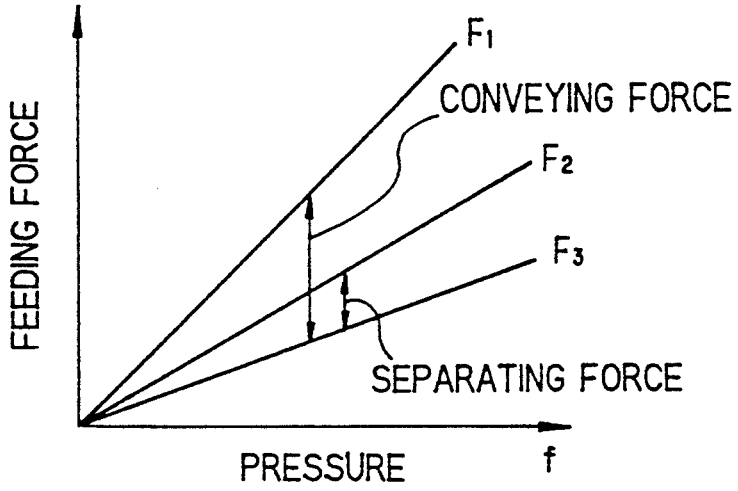

When the reverse roller 6 is in direct contact with the paper feed roller 3 (that is no paper is held in the nip), or a single sheet of paper is fed into the nip, the reverse roller 6 is driven by the paper feed roller 3 (FIG. 6(*a*)). In contrast, when two or more sheets unseparated are fed into the nip, if the reversing force of the reverse roller acting on a second sheet is larger than the conveying force acting on the second sheet generated by the combination of acting pressure of the reverse roller and the frictional coefficient $\mu_3$ between the sheets unseparated, the lower sheet is pushed back to prevent plural sheet feeding (FIG. 6(*b*)).

Figure 7:
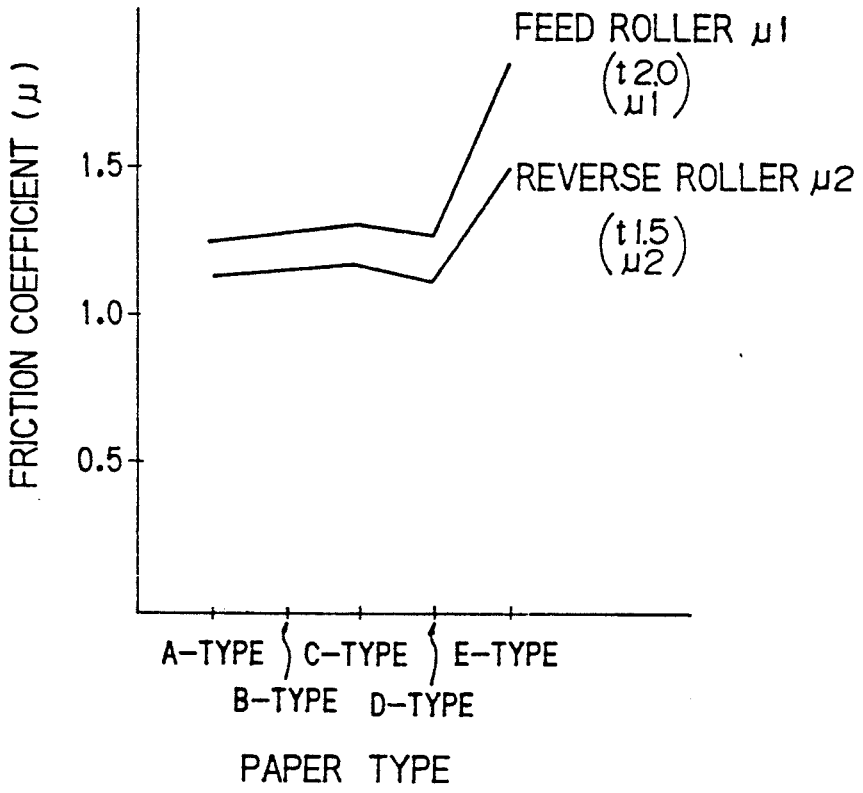
FIG. 7 is a characteristic chart showing relations of friction coefficient between various types of copy paper and the rollers in the paper feeding device of frictionally separating roller mechanism shown in FIG. 4.

In the paper feeding device in accordance with this embodiment, sheets may be separated under only the effect of friction coefficient, by the force provided by the reverse roller, therefore, it is possible to adopt or select a highest friction coefficient for the roller. Accordingly, an extremely wide variety of sheets is applicable. For reference, FIG. 7 shows characteristic plots showing variations of friction coefficient for each of the paper feed roller and the reverse roller, depending upon the types of copying sheets, which are exclusively used to the copiers manufactured by the present applicant. As is apparent from FIG. 7, the friction coefficient $\mu_2$ for reverse roller takes values always lower than the friction coefficient $\mu_1$ for paper feed roller by 10 to 20 percents. For the measurement, a rubber having a rubber hardness of 25 degree was used. In the measurement by the rubber hardness meter, the paper feed roller made with polynorbornene rubber had a hardness of 25 degree and the reverse roller with the same rubber had that of 55 degree.

Although, in the above description, the paper feeding device with no torque limiter for the reverse roller 6 was exemplified, a torque limiter for reverse roller may be provided as used in the prior art paper feeding device of frictionally separating roller mechanism.

As can be understood from the description heretofore, according to the paper feeding device of frictionally separating roller mechanism of the present invention, it is possible to set up a pressing force of the rollers with a large margin, unlike in the conventional paper feeding device of frictionally separating roller mechanism in which the pressing force have to be set up with a narrow margin.

Since the paper feed roller and reverse roller are made with the same material as have been in the prior art, it is possible to maintain the merits, obtained in the prior art, that the friction coefficient for the both rollers vary in the same manner (that is, no relational change occurs with the change of environment or with the passage of time).

In addition, no torque limiter is needed, thus reducing the cost.

What is claimed is:

1. A paper feeding device comprising:

a pick-up roller being pressed onto a surface of a sheet stack for delivering with frictional force a sheet into a nip defined between a paper feed roller and a reverse roller;

said paper feed roller sending out with friction the sheet delivered by said pick-up roller in its rotational direction; and said reverse roller being driven by said feed roller when it is in direct contact with the paper feed roller or a sheet of paper is fed into the nip, and pushing back the lower sheet by its frictional force with the sheet when two or more sheets piled are fed into the nip, being characterized in that said paper feed roller and reverse roller are made with polynorbornene rubber, and the difference of the rubber thickness $t_1$ of the paper feed roller and the rubber thickness $t_2$ of the reverse roller, that is, the value $(t_1-t_2)$ is 0.5 mm or more.

* * * * *